US011007628B2

(12) United States Patent
Burgess

(10) Patent No.: US 11,007,628 B2
(45) Date of Patent: May 18, 2021

(54) FITTING INSERTION TOOL

(71) Applicant: Burgess Tooling LLC, Rogers, MN (US)

(72) Inventor: Lucas Steven Burgess, Rogers, MN (US)

(73) Assignee: Burgess Tooling LLC, Rogers, MN (US)

( * ) Notice: Subject to any disclaimer, the term of this patent is extended or adjusted under 35 U.S.C. 154(b) by 0 days.

(21) Appl. No.: 17/045,526

(22) PCT Filed: Apr. 8, 2019

(86) PCT No.: PCT/US2019/026401

§ 371 (c)(1),
(2) Date: Oct. 6, 2020

(87) PCT Pub. No.: WO2019/199700

PCT Pub. Date: Oct. 17, 2019

(65) Prior Publication Data

US 2021/0086334 A1 Mar. 25, 2021

Related U.S. Application Data

(60) Provisional application No. 62/655,142, filed on Apr. 9, 2018.

(51) Int. Cl.

| | |
|---|---|
| ***B25B 27/10*** | (2006.01) |
| ***B25B 7/12*** | (2006.01) |
| *B25B 7/02* | (2006.01) |

(52) U.S. Cl.

CPC ..... *B25B 27/10* (2013.01); *B25B 7/12* (2013.01); *B25B 7/02* (2013.01)

(58) Field of Classification Search

CPC .. B25B 27/10; B25B 7/10; B25B 7/12; B25B 7/14; B25B 7/16; B25B 7/02; B25B 9/00;

(Continued)

(56) References Cited

U.S. PATENT DOCUMENTS 2,817,989 A * 12/1957 Nowak ..... B25B 13/22 81/362
3,299,496 A * 1/1967 Christensen ..... B25B 27/10 29/237

(Continued)

OTHER PUBLICATIONS

International Search Report and Written Opinion in PCT/US2019/026401 dated Jun. 25, 2019 (5 pages).

*Primary Examiner* — Robert J Scruggs
(74) *Attorney, Agent, or Firm* — Foley & Lardner LLP

(57) ABSTRACT

A tool for inserting a barbed fitting of a spile assembly into a conduit includes a main body including a grip, a lever pivotally coupled to the main body and including a trigger, and a jaw assembly. The jaw assembly includes a first jaw extending along an actuation axis and a second jaw coupled to the trigger and moveably coupled to the first jaw. The first jaw is translatably coupled to the main body such that an angle between the actuation axis and the main body is substantially constant. The first jaw and the second jaw are configured to receive the conduit therebetween. The first jaw is configured to move in a first longitudinal direction relative to the main body in response to movement of the trigger toward the grip.

13 Claims, 14 Drawing Sheets

(58) Field of Classification Search
CPC .. B25B 9/02; B25B 9/04; B25B 27/16; B25B 31/00; B25B 27/00; B25B 27/14; F16L 1/09; B21D 39/046; B21D 39/04
See application file for complete search history.

(56) References Cited

U.S. PATENT DOCUMENTS

| | | | | |
|---|---|---|---|---|
| 7,114,229 | B1 | 10/2006 | Nago | |
| 9,032,598 | B2 | 5/2015 | Eldar | |
| 2007/0099460 | A1* | 5/2007 | Holp | B25B 27/10 439/157 |

* cited by examiner

FITTING INSERTION TOOL

CROSS-REFERENCE TO RELATED PATENT APPLICATION

This application claims the benefit of U.S. Provisional Patent Application No. 62/655,142, filed Apr. 9, 2018, which is incorporated herein by reference in its entirety.

BACKGROUND

Hoses are commonly used to fluidly couple various devices to sources of fluid. To connect hoses to such sources of fluid, devices, or other hoses, barbed, friction fit, or other types of fittings are used. Barbed fittings can include a series of concentric tapered protrusions that all face the same direction. Friction fit fittings can have a smooth outer surface that frictionally engages with the hose. To couple the barbed fitting to the hose, the smallest portion of the barbed fitting is inserted into an end of the hose. The hose is then forced onto the fitting, stretching the hose to form a fluid-tight seal. This process is normally completed by hand, and can be difficult to complete without damaging the hose or the fitting or harming a user's hands.

SUMMARY OF THE INVENTION

At least one embodiment relates to a tool for inserting a barbed fitting of a spile assembly into a conduit. The tool includes a main body having a grip, a lever pivotally coupled to the main body, the lever including a trigger, and a jaw assembly. The jaw assembly includes a first or top jaw extending along an actuation axis and a second or bottom jaw coupled to the trigger and movably coupled to the top jaw. The top jaw is translatably coupled to the main body such that an angle between the actuation axis and the main body is substantially constant. The top jaw and the bottom jaw are configured to receive the conduit therebetween. The top jaw is configured to move in a first longitudinal direction relative to the main body in response to movement of the trigger toward the grip.

Another embodiment relates to a fitting insertion tool including a main body having a handle, a lever pivotally coupled to the main body, and a jaw assembly including a first jaw and a second jaw, at least one of the first jaw and the second jaw being movably coupled to the main body. The lever is rotatable relative to the main body through a range of motion, the range of motion including a jaw closing section and a jaw translation section. In response to the trigger moving through the jaw closing section of the range of motion, the second jaw is configured to move relative to the first jaw while the first jaw remains stationary relative to the body. In response to the trigger moving through the jaw translation section of the range of motion, the first jaw is configured to remain stationary relative to the second jaw while the second jaw moves relative to the main body.

Another embodiment relates to a fitting installation tool including a main body including a handle, a backstop fixedly coupled to the main body, a jaw assembly movably coupled to the main body, and a trigger coupled to the main body and the jaw assembly. The jaw assembly includes a first jaw and a second jaw selectively repositionable relative to one another between a closed configuration and an open configuration. The trigger is configured to move the jaw assembly longitudinally toward the backstop in response to a movement of the trigger toward the handle. At least one of the first jaw and the second jaw defines a recess extending longitudinally and configured to receive a conduit.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, a fitting insertion tool is shown. The fitting insertion tool is a hand tool configured to facilitate insertion of fittings into hoses. The fitting insertion tool includes a main body coupled to a handle. A jaw assembly is translatably coupled to the main body as part of a four bar linkage. Accordingly, a first jaw of the jaw assembly maintains a substantially constant angular orientation relative to the main body throughout its travel. A second jaw is pivotally coupled to the first jaw. A lever is pivotally coupled to the main body and includes an interface portion and a trigger. A trigger link couples the interface portion to the second jaw. A backstop is fixedly coupled to the main body and extends in front of the jaw assembly.

In operation, a hose is placed between the jaws, and a user applies a gripping force to draw the trigger toward the handle. As the lever rotates, the lever forces the second jaw upward to clamp the hose between the first and second jaws. Until the hose is clamped, the first jaw remains stationary. Once a threshold compressive force between the jaws has been achieved, further rotation of the trigger causes the jaw assembly to translate toward the backstop. A device including a fitting (e.g., a barbed fitting, etc.) is placed between the backstop and the hose. By rotating the trigger further, the hose is forced onto the fitting and fluidly coupled to the device.

Figure 1:
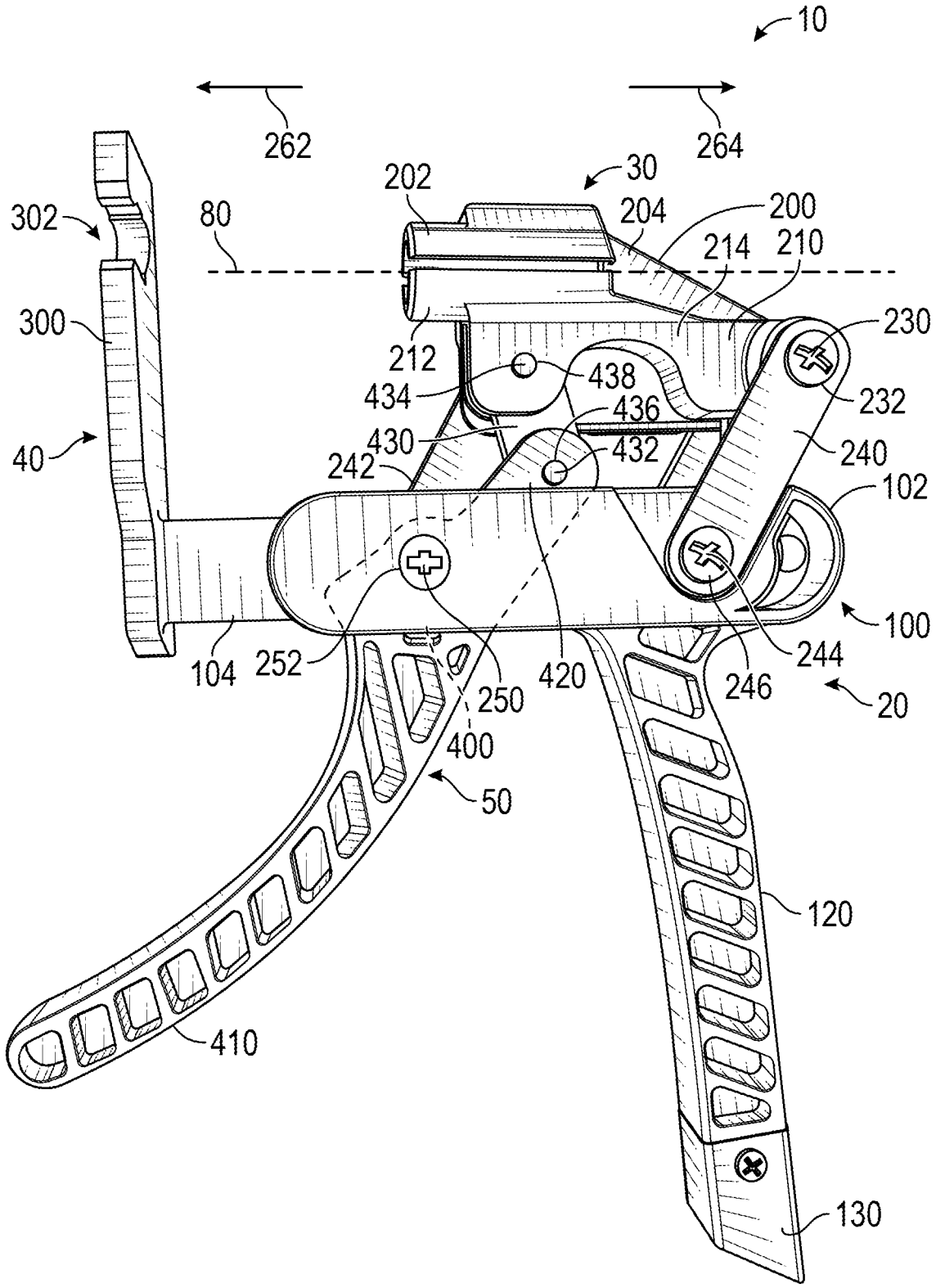
FIG. 1 is a left side view of a fitting insertion tool, according to an exemplary embodiment.

Referring to FIG. 1, a hand tool, a power tool, a barbed fitting insertion tool, fitting insertion tool, barbed fitting installation tool, fitting installation tool, pliers, or assembly device is shown as tool 10 according to an exemplary embodiment. The tool 10 is configured to receive a fitting and a conduit (e.g., a hose, a tube, a pipe, etc.) and, in response to an input (e.g., a gripping motion) from a user, insert the fitting into the conduit. The tool 10 may be a hand tool, a power tool, or another type of tool.

Referring to FIGS. 1-4, the tool 10 includes a body portion or stationary portion, shown as main body 20, a conduit manipulation assembly or conduit interface assembly, shown as jaw assembly 30, a stopping plate or wall, shown as backstop 40, and an activator, shown as lever 50. The main body 20 is translatably coupled to the jaw assembly 30 (e.g., by the rear four bar links 240 and the front four bar link 242). The backstop 40 is fixedly coupled to the main body 20 and extends directly in front of the jaw assembly 30. The lever 50 is pivotally coupled to both the main body 20 and the jaw assembly 30.

Figure 10:
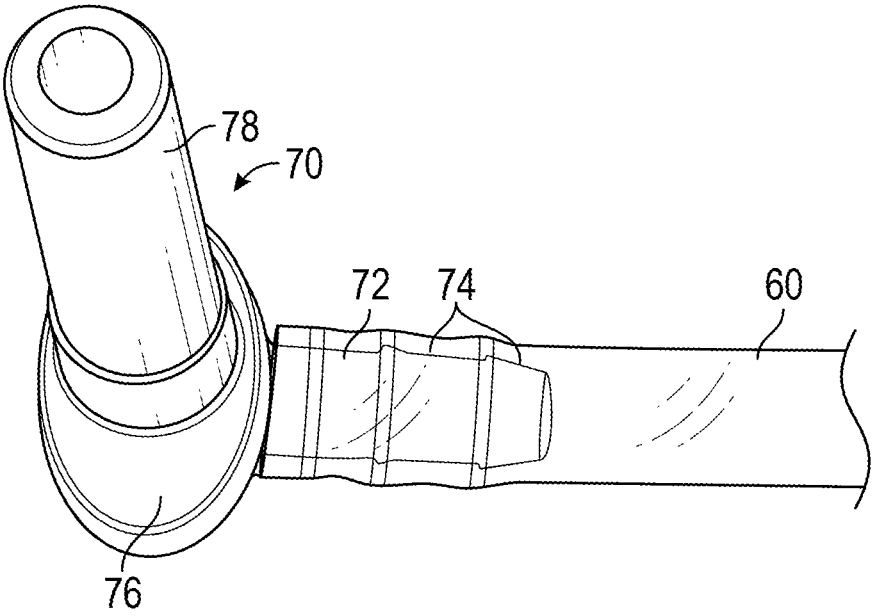
FIG. 10 is a perspective view of a conduit engaged with a barbed fitting of a device.
Figure 11:
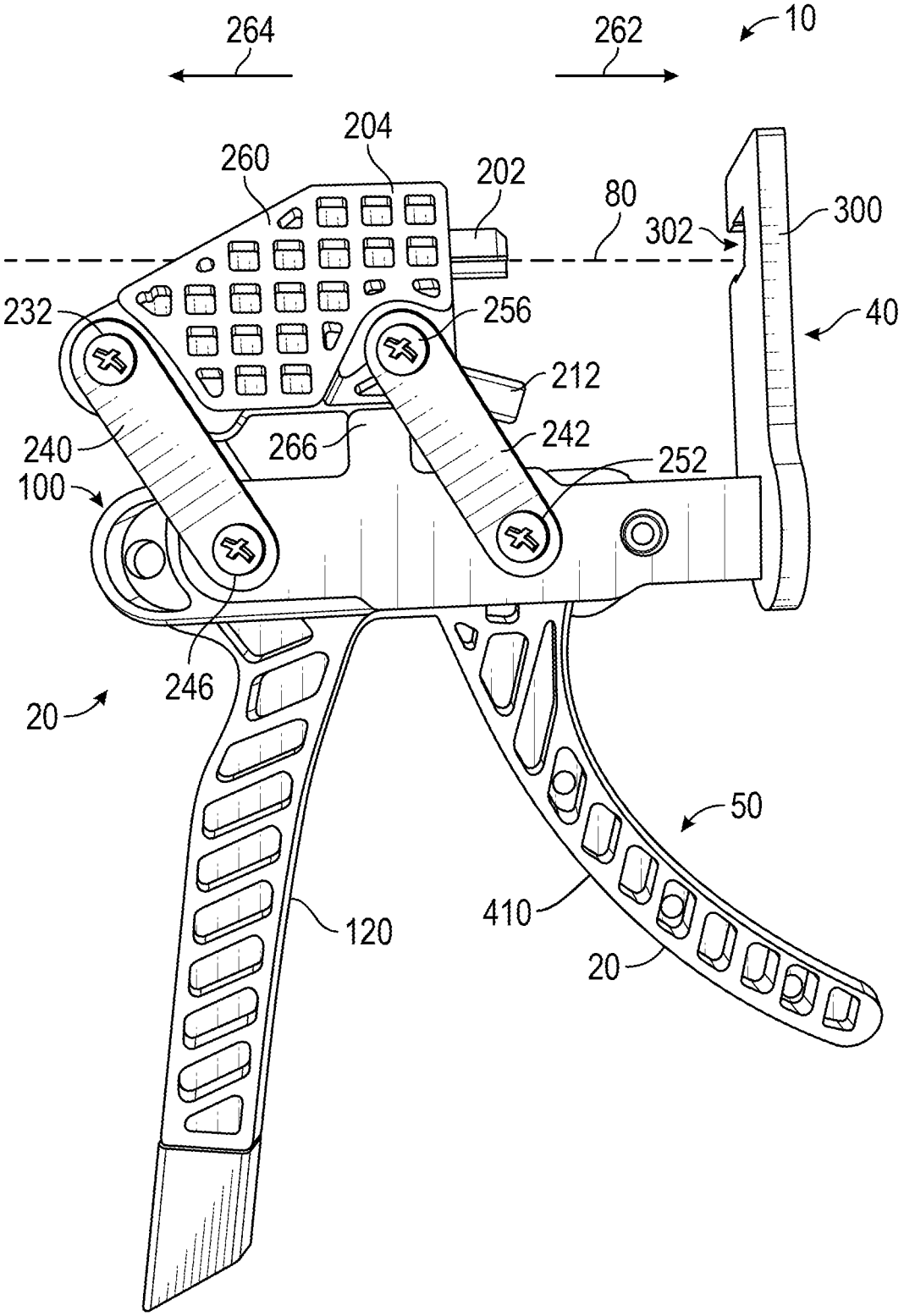
FIGS. 11-13 are right side views of the fitting insertion tool of FIG. 1 in various positions throughout the range of motion of the fitting insertion tool.
Figure 12:
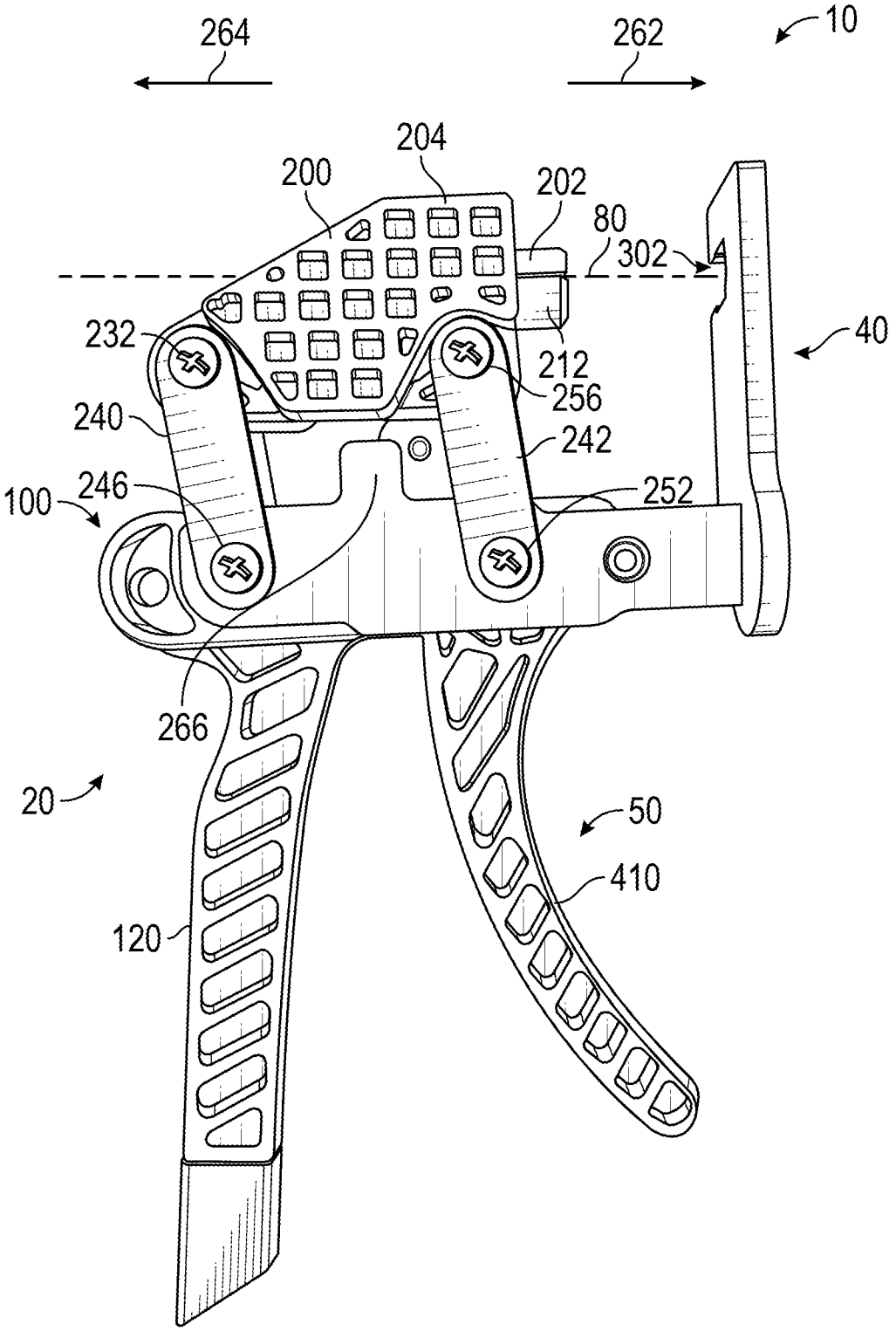
Figure 13:
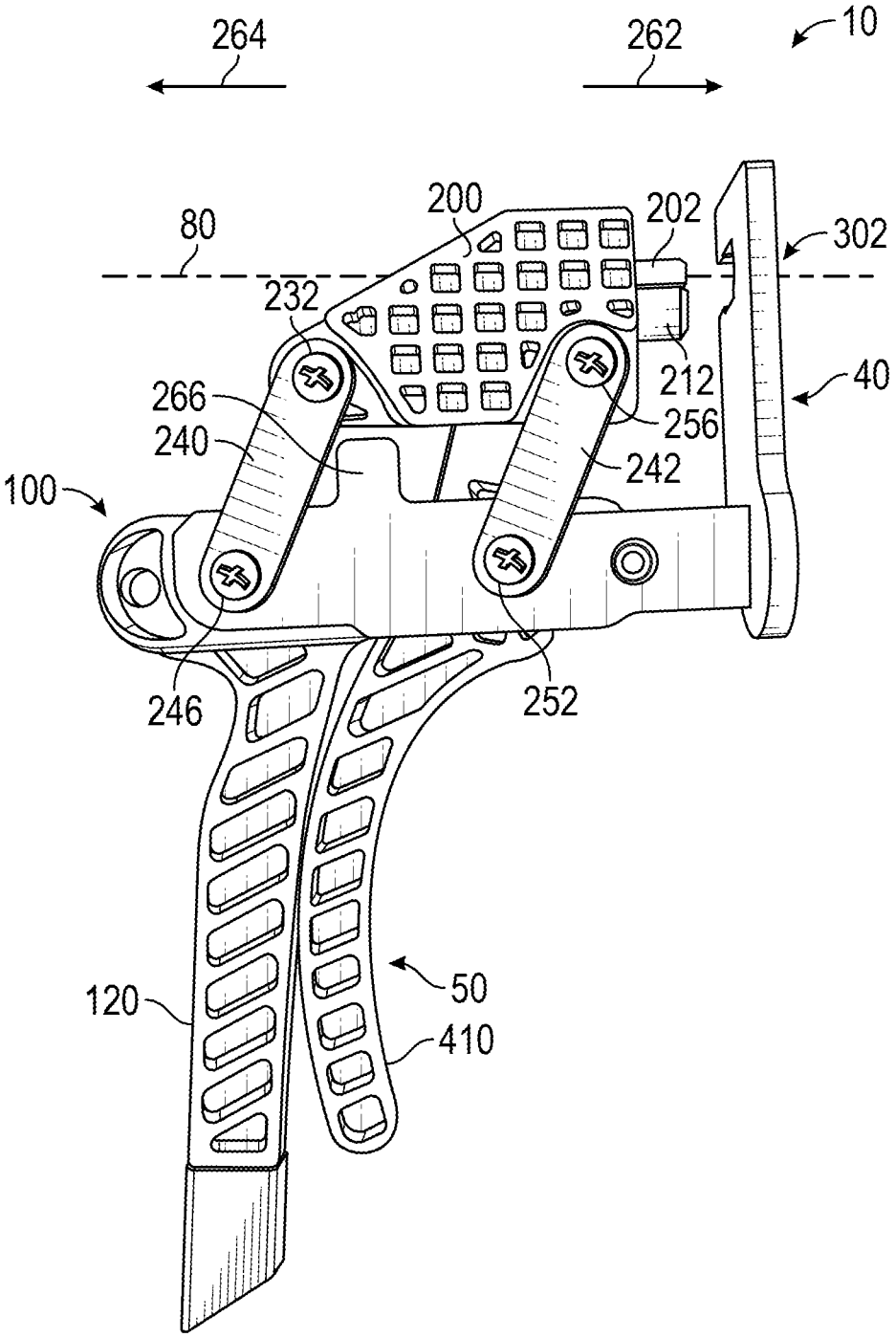

Referring to FIGS. 5-10, the tool 10 is configured to assemble a conduit (e.g., a tube, a hose, a pipe, a duct, etc.), shown as conduit 60, with a device 70 to form a fluid-tight connection. An end of the conduit 60 defines an aperture 62 fluidly coupled to a corresponding aperture at an opposing end of the conduit 60. The aperture 62 is configured to receive the device 70. FIG. 10 illustrates the conduit 60 and the device 70 in an assembled configuration with the device 70 inserted into the aperture 62.

The device 70 includes a fitting (e.g., a press-on fitting, a press-in fitting, a press-fit fitting, a barbed fitting, a smooth fitting, a friction fit fitting, etc.), shown as fitting 72. As shown in FIGS. 5-10, fitting 72 has a series of barbed protrusions 74. The fitting 72 is fixedly coupled to and extends away from a body 76 of the device 70. Specifically, the fitting 72 extends along an axis, and the barbed protrusions 74 extend radially outward from the axis, are substantially radially symmetrical about the axis, and are aligned with the axis. The barbed protrusions 74 are tapered such that the barbed protrusions 74 decrease in cross-sectional area (e.g., and diameter) as the barbed protrusions 74 extend away from the body 76. The tapered shape of the barbed protrusions 74 facilitate entry into the conduit 60 through the aperture 62 and resist removal from the conduit 60. Although the fitting 72 is shown as including a pair of barbed protrusions 74, the fitting 72 may include more or fewer protrusions. In other embodiments, the barbed protrusions 74 are omitted, and the conduit 60 has a friction fit on a smooth exterior surface of the fitting (e.g., frictionally engages the fitting with sufficient force to prevent relative movement during normal use).

In the embodiment shown in FIGS. 5-10, the device 70 is a spile, spout, or tap assembly or device (e.g., a maple sap spile assembly) configured to extract sap from a tree (e.g., a maple tree) and direct the sap into the conduit 60 for transport to a container (e.g., a bucket, a tank, a pipeline, etc.) for subsequent processing (e.g., production of maple syrup). A protrusion or spout, shown as spile 78, extends outward from the body 76. In some embodiments, the spile 78 extends approximately perpendicular to the fitting 72. The spile 78 is configured to be pressed into an aperture or recess drilled into a tree such that sap from the tree enters the spile 78 over time. The spile 78 is fluidly coupled to the fitting 72 through the body 76, facilitating the flow of sap through the spile 78, the body 76, and the fitting 72 and into the conduit 60.

Although the tool 10 is shown coupling the conduit 60 to the fitting 72 of a sap spile assembly, it should be understood that the tool 10 may be used with any type of device 70 that utilizes a fitting 72. By way of example, the device 70 may be a component of a cooling system (e.g., a connector, a radiator, a coolant reservoir, etc.), such as a cooling system for a vehicle. By way of another example, the conduit 60 may be a fuel line configured to transfer fuel, and the device 70 may be part of a fuel system (e.g., of a vehicle, etc.). By way of another example, the conduit 60 may be a vacuum line configured to transfer air or another gas at a negative pressure, and the device 70 may be part of a vacuum system (e.g., a compressor, of a vehicle, etc.). By way of another example, the device 70 may be a component of a recirculating system (e.g., a connector, a pump, a filter, etc.) for a container of water, such as a pool, hot tub, or a fish tank. By way of another example, the device 70 may be a component used in medical applications, such as the transportation of liquids and/or gasses (e.g., drugs, blood, etc.), inflation and deflation of medical balloons, or catheters. By way of another example, the condut 60 may be used to deliver food and/or beverages (e.g., melted cheese, sour cream, frosting, frozen dessert, beer, soda, etc.). The device 70 and the conduit 60 may be used to transport liquid and/or gas. In some embodiments, a hose clamp or another similar device is clamped around the conduit 60 and the fitting 72 to increase the strength of the connection between the conduit 60 and the fitting 72.

Referring to FIGS. 5-9 and 10-13, in operation, an end of the conduit 60 is placed into the jaw assembly 30, and the device 70 is placed between the jaw assembly 30 and the backstop 40 with the fitting 72 substantially aligned with the aperture 62. To activate the tool 10, a user presses the lever 50 toward the main body 20. As the lever 50 rotates relative to the main body 20, the jaw assembly 30 clamps down onto the conduit 60, coupling the end of the conduit 60 to the jaw assembly 30. Further movement of the lever 50 moves the jaw assembly 30 and the end of the conduit 60 toward the backstop 40 and the fitting 72. The jaw assembly 30 defines an axis, shown in FIG. 1 as actuation axis 80. The actuation axis 80 may have a substantially constant angular orientation relative to the main body 20 and the backstop 40 throughout the range of motion of the jaw assembly 30. As the jaw assembly 30 moves along the actuation axis 80, the fitting 72 enters the aperture 62, and the conduit 60 begins to push against the device 70. The backstop 40 resists movement of the device 70, and the conduit 60 is forced onto the fitting 72. By releasing the lever 50, the jaw assembly 30 releases the conduit 60, and the assembly of the conduit 60 and the device 70 can be removed.

Figure 2:
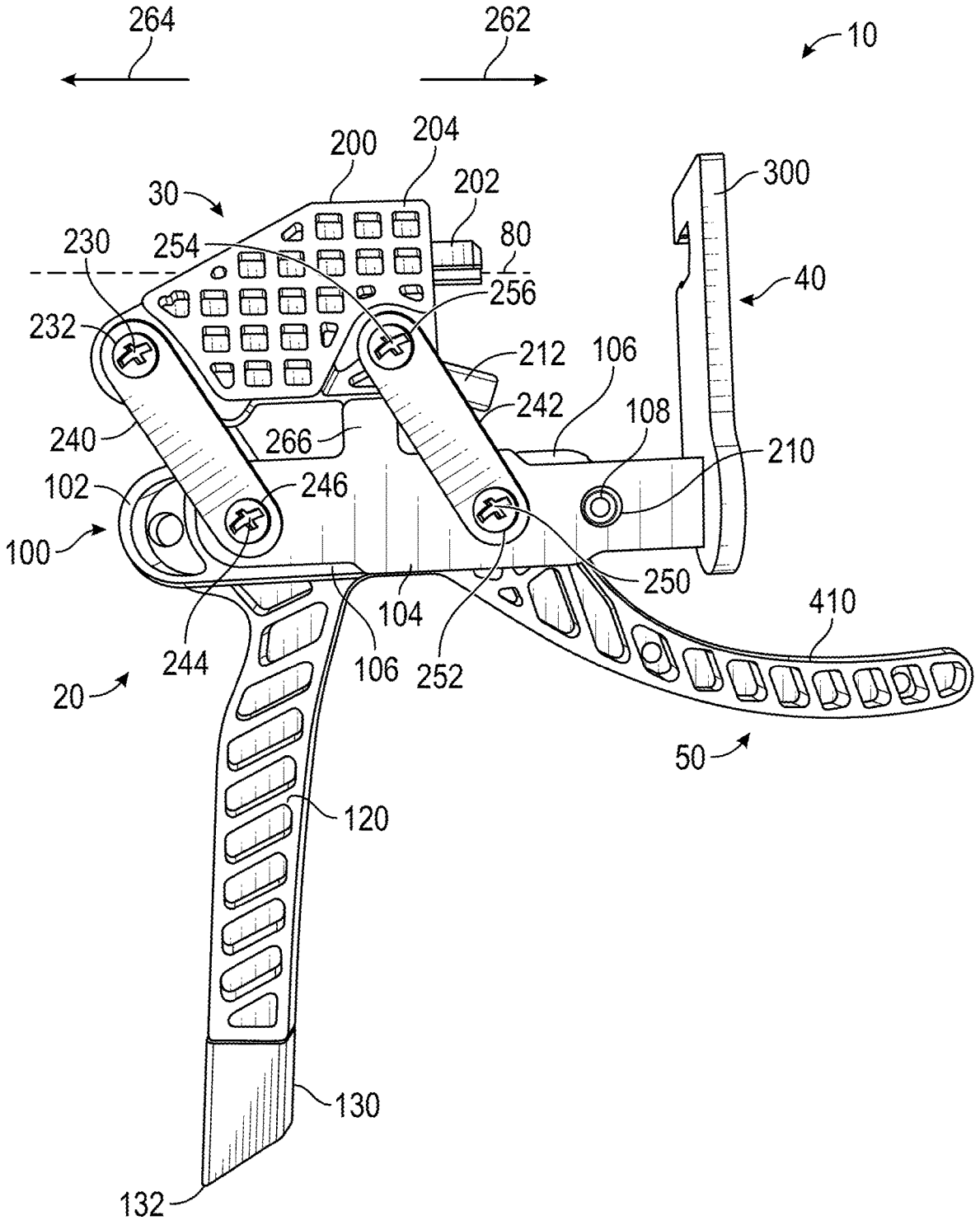
FIG. 2 is a right side view of the fitting insertion tool of FIG. 1.

Referring to FIGS. 1-4, the main body 20 includes a first, main, core, or base portion or section, shown as base portion 100. In some embodiments, the base portion 100 extends substantially parallel to the actuation axis 80. The base portion 100 includes a first component, shown as housing body 102, coupled to a second component, shown as backer plate 104. As shown in FIG. 2, the housing body 102 includes a pair of protrusions or flanges, shown as retention flanges 106. The retention flanges 106 receive the backer plate 104 therebetween, limiting (e.g., preventing) movement of the backer plate 104 relative to the housing body 102. The housing body 102 includes a protrusion, shown as peg 108, that is received within a corresponding peg aperture 110 defined by the backer plate 104 to further limit relative movement of the backer plate 104 relative to the housing body 102. Together, the retention flanges 106, the peg 108, and the peg aperture 110 facilitate alignment of the backer plate 104 with the housing body 102 (e.g., to facilitate insertion of bolts 246 and 252 through corresponding apertures in the backer plate 104 and the housing body 102).

The main body 20 further includes a support, grip, or handle, shown as grip 120, extending downward from the base portion 100. In some embodiments, the grip 120 extends substantially perpendicular to the actuation axis 80. The grip 120 is fixedly coupled to the housing body 102. In some embodiments, the grip 120 and the housing body 102 are integrally formed. The grip 120 facilitates holding the tool 10. The grip 120 further facilitates orienting the tool 10 and applying a gripping force to actuate the trigger 410. During operation, a user may hold the grip 120 between their thumb and palm.

The main body 20 further includes a static tool, shown as scraper 130, positioned at an end of the grip 120 opposite the base portion 100. The scraper 130 has a substantially trapezoidal side profile (e.g., as viewed from the front or the rear). The scraper 130 defines a laterally-extending edge, shown as scraping edge 132, positioned at a vertex of the trapezoidal side profile. The scraping edge 132 is configured to facilitate scraping the bark off of a tree prior to insertion of the device 70. In some embodiments, the scraper 130 is made from steel or another relatively hard material to facilitate maintaining the scraping edge 132 over an extended period of use.

Figure 14:
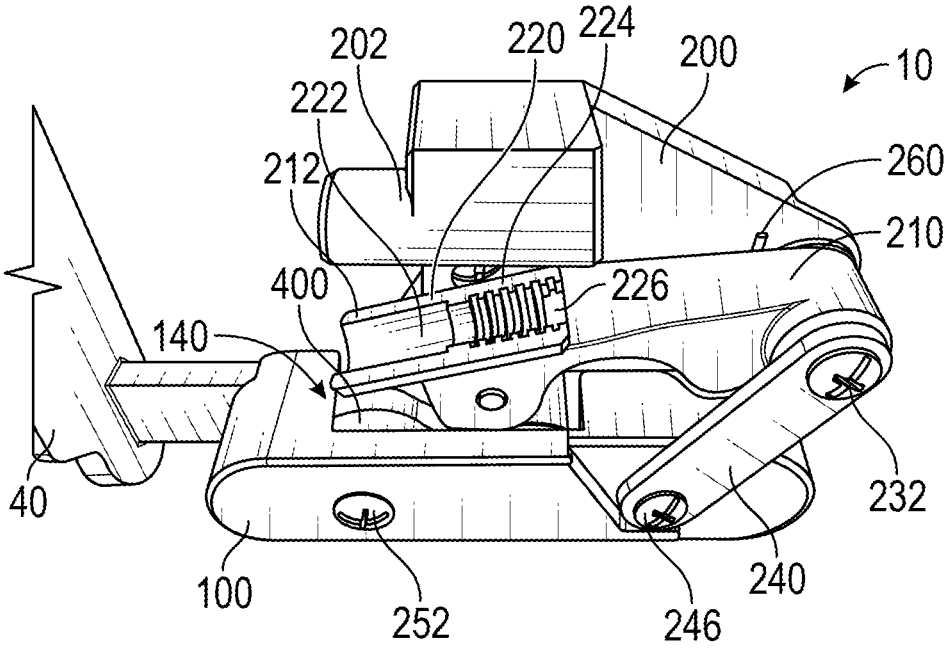
FIG. 14 is a top perspective view of the fitting insertion tool of FIG. 1.
Figure 15:
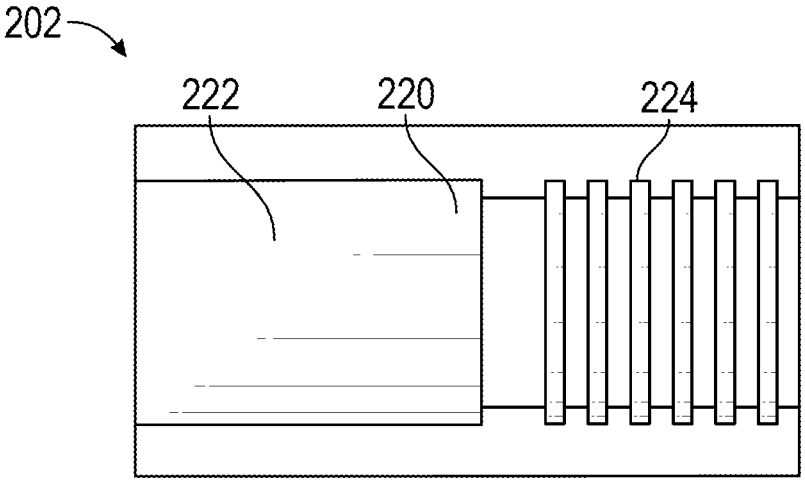
FIG. 15 is a bottom view of a top jaw of the fitting insertion tool of FIG. 1.

Referring to FIG. 14, the base portion 100 defines a vertically-extending aperture, shown as lever aperture 140, through which the lever 50 extends. Specifically, the housing body 102 defines a recess, and the backer plate 104 extends across a portion of the recess to define the lever aperture 140. The lever aperture 140 is positioned between the housing body 102 and the backer plate 104. The lever aperture 140 is positioned longitudinally forward (e.g., closer to the backstop 40 as measured parallel to the actuation axis 80) of the grip 120.

Referring to FIGS. 1-4, 14, and 15, the jaw assembly 30 includes a first jaw subassembly, top jaw body, or head, shown as head 200. The head 200 includes a jaw portion or first jaw, shown as top jaw 202, and a base portion, frame portion, or adapter, shown as top jaw frame 204. The top jaw 202 and the top jaw frame 204 are fixedly coupled to one another. In some embodiments, the top jaw 202 and the top jaw frame 204 are integrally formed. The top jaw frame 204 extends in a plane substantially perpendicular to a lateral axis (e.g., a vertical and longitudinal plane). The top jaw frame 204 is laterally offset from the top jaw 202.

The jaw assembly 30 further includes a second jaw assembly, bottom jaw body, or tongue, shown as tongue 210. The tongue 210 includes a jaw portion or second jaw, shown as bottom jaw 212, and a base portion, frame portion, or adapter, shown as bottom jaw frame 214. The bottom jaw 212 and the bottom jaw frame 214 are fixedly coupled to one another. In some embodiments, the bottom jaw 212 and the bottom jaw frame 214 are integrally formed. The bottom jaw 212 and the bottom jaw frame 214 are substantially laterally aligned. Offsetting the top jaw frame 204 laterally from the top jaw 202 facilitates clearance to align bottom jaw 212 with top jaw 202.

Referring to FIGS. 3, 4, 14, and 15, the top jaw 202 and the bottom jaw 212 are configured to receive the conduit 60 therebetween. Specifically, the top jaw 202 and the bottom jaw 212 are configured to firmly hold the conduit 60 in place relative to the jaw assembly 30 while still permitting the fitting 72 to be inserted into the conduit 60. The top jaw 202 and the bottom jaw 212 each define a recess, slot, or aperture, shown as conduit receiving recess 220, configured to receive the conduit 60. Each conduit receiving recess 220 has a substantially semicircular cross-section. When the jaw assembly 30 is in a closed configuration where the top jaw 202 and the bottom jaw 212 are positioned adjacent one another, the conduit receiving recesses 220 face one another, collectively forming a combined recess having a substantially circular cross section.

Each conduit receiving recess 220 includes a first portion or section (e.g., a smooth bore section, a wide section, etc.), shown as smooth section 222, and a second portion or section (e.g., a ribbed section, a narrow section, etc.), shown as ribbed section 224. The smooth section 222 and the ribbed section 224 may be approximately equal in length (e.g., as measured longitudinally). A longitudinal distance between the backstop 40 and the smooth section 222 is less than a longitudinal distance between the backstop 40 and the ribbed section 224 (i.e., the smooth section 222 is positioned between the backstop 40 and the ribbed section 224). The smooth section 222 has a substantially smooth exterior boundary (e.g., defined by a surface of the corresponding jaw). The ribbed section 224 is defined by a series of circumferentially-extending ribs that roughen the exterior boundary of the ribbed section 224. A cross-sectional area of the smooth section 222 (e.g., as measured along a length of the jaw) is greater (e.g., has a larger radius) than a cross-sectional area of at least part of the ribbed section 224 (e.g., the part of the ribbed section 224 defined by the inner surfaces of the ribs). The bottom jaw 212 includes a protrusion, shown as conduit engagement rib 226, positioned along the conduit receiving recess 220 opposite the smooth section 222. The conduit engagement rib 226 is substantially flat and further reduces a cross-sectional area of the conduit receiving recess 220 beyond that of the ribbed section 224.

The actuation axis 80 is defined with respect to the head 200. Specifically, the actuation axis 80 may extend longitudinally, and the top jaw 202 may extend along (e.g., parallel to) the actuation axis 80. When the jaw assembly 30 is in a closed configuration, the bottom jaw 212 may extend substantially along the actuation axis 80 as well. The actuation axis 80 may be approximately centered between the top jaw 202 and the bottom jaw 212. By way of example, in embodiment where the conduit receiving recesses have semicircular cross sections, the actuation axis 80 may be positioned at the radial center of the top jaw 202.

During operation, the conduit 60 is placed between the top jaw 202 and the bottom jaw 212 with the end of the conduit 60 approximately flush with a front face of the top jaw 202. As a compressive force is applied to the jaw assembly 30 (e.g., through the lever 50), the curved faces of the jaws act to center the conduit 60 between the top jaw 202 and the bottom jaw 212. The portions of the jaws surrounding the ribbed section 224 and the conduit engagement rib 226 contact the conduit 60 first, compressing the conduit 60. The conduit 60 engages with the ribs, reducing or eliminating slip of the conduit 60 along the actuation axis 80 and facilitating insertion of the fitting 72 into the conduit. The increased cross-sectional area of the smooth section 222 permits the end of the conduit 60 to be centered without substantially deforming the aperture 62. This facilitates alignment of the aperture 62 with the fitting 72 while permitting the conduit 60 to expand as the fitting 72 is inserted into the conduit 60. The dimensions of the conduit receiving recess 220 may be selected based on the size of the conduit 60 and the fitting 72 that will be used with the tool 10.

The head 200 is pivotally coupled to the tongue 210 about a laterally-extending axis, shown as jaw pivot axis 230.

Pivoting of the tongue 210 relative to the head 200 about the jaw pivot axis 230 permits opening and closing the jaw assembly 30 to control a distance between the top jaw 202 and the bottom jaw 212. A pin or fastener, shown as bolt 232, extends through corresponding apertures in the head 200 and the tongue 210 to pivotally couple the jaws. The jaw pivot axis 230 extends through the center of the bolt 232. The jaw pivot axis 230 is offset longitudinally behind (i.e., away from the backstop 40 relative to) and below the top jaw 202. In other embodiments, the head 200 may be slidably or translatably coupled to the tongue 210.

Referring to FIGS. 1-4, the jaw assembly 30 is translatably coupled to the main body 20 by a series of connecting members or links, shown as a pair of rear four bar links 240 and a front four bar link 242. The rear four bar links 240 are positioned on opposite sides of the jaw assembly 30 and the main body 20. A first end of each rear four bar link 240 is pivotally coupled to the base portion 100 about a laterally-extending axis, shown as rear four bar axis 244. Specifically, a fastener or pin, shown as bolt 246, extends through corresponding apertures in the rear four bar links 240, the housing body 102, and the backer plate 104 to pivotally couple the rear four bar links 240 to the base portion 100. The rear four bar axis 244 extends through the center of the bolt 246. A second end of each rear four bar link 240 is pivotally coupled to the head 200 and the tongue 210 about the jaw pivot axis 230. In other embodiments, the second end of each rear four bar link 240 is pivotally coupled to the head 200 about another laterally-extending axis (e.g., that is offset from the jaw pivot axis 230).

Figure 3:
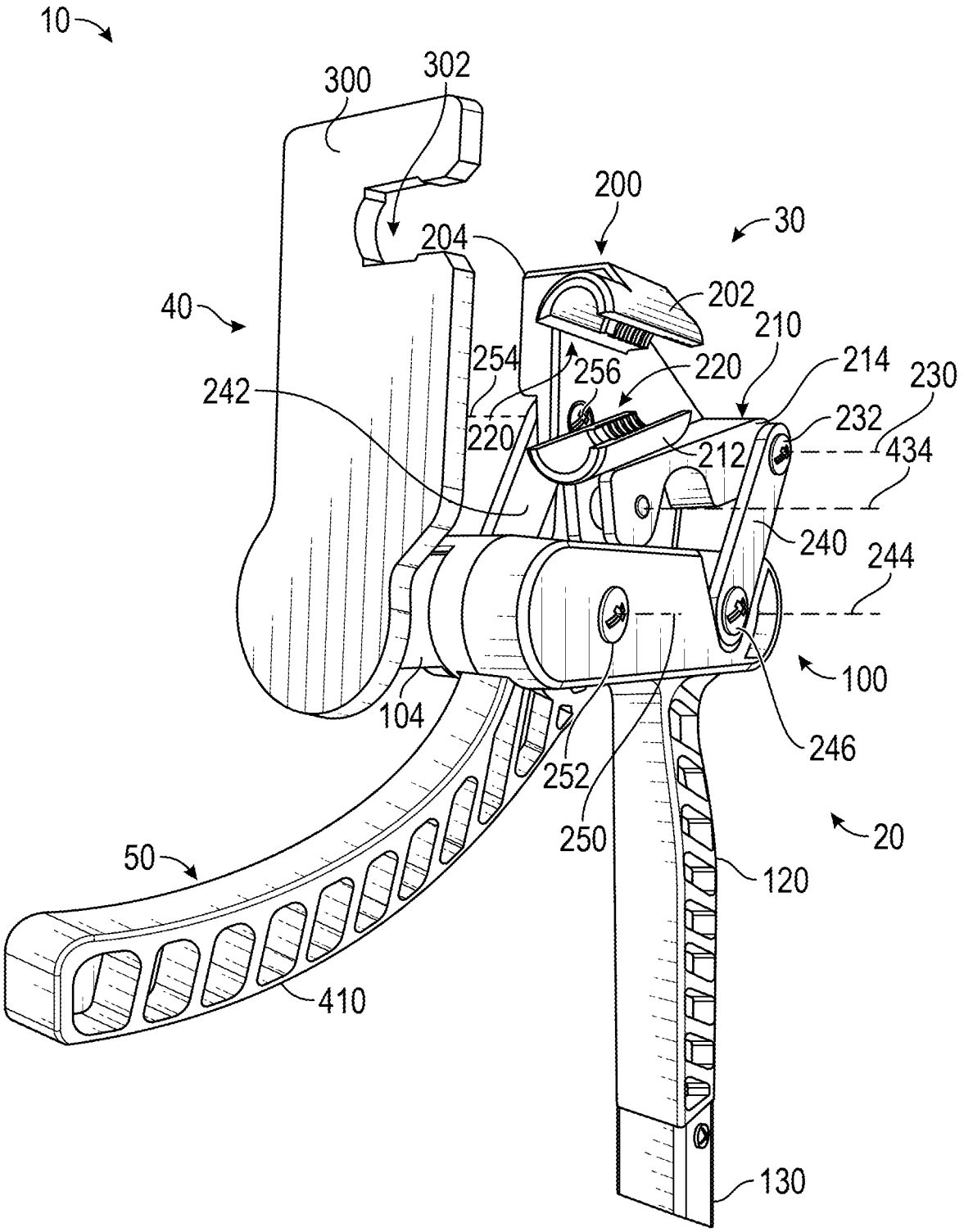
FIG. 3 is a front left perspective view of the fitting insertion tool of FIG. 1.

Referring to FIGS. 2 and 3, the front four bar link 242 is positioned on a right side of the main body 20 and the jaw assembly 30 adjacent the backer plate 104. A first end of the front four bar link 242 is pivotally coupled to the base portion 100 about a laterally-extending axis, shown as lever pivot axis 250. Specifically, a fastener or pin, shown as bolt 252, extends through corresponding apertures in the front four bar link 242, the housing body 102, the lever 50, and the backer plate 104 to pivotally couple the front four bar link 242 to the base portion 100. The lever pivot axis 250 extends through the center of the bolt 252. A second end of the front four bar link 242 is pivotally coupled to the top jaw frame 204 about a laterally-extending axis, shown as front four bar axis 254. Specifically, a fastener or pin, shown as bolt 256, extends through corresponding apertures in the front four bar link 242 and the top jaw frame 204 to pivotally couple the front four bar link 242 to the head 200. The front four bar axis 254 extends through the center of the bolt 256. As shown in FIG. 3, a head of the bolt 256 has a relatively low profile that facilitates clearance between the bolt 256 and the tongue 210. This facilitates closure of the jaw assembly 30 without interference from the bolt 256.

The rear four bar links 240, the front four bar link 242, the base portion 100, and the top jaw frame 204 are arranged as a four bar linkage, translatably coupling the head 200 to the main body 20. The distances between the various lateral axes control the angular orientation of the head 200 relative to the main body 20 as the jaw assembly 30 translates. In some embodiments, a first distance between the jaw pivot axis 230 and the rear four bar axis 244 is substantially equal to a second distance between the lever pivot axis 250 and the front four bar axis 254. In some such embodiments, a third distance between the jaw pivot axis 230 and the front four bar axis 254 is substantially equal to a fourth distance between the rear four bar axis 244 and the lever pivot axis 250. In some embodiments, the third distance is not equal to (e.g., greater than) the first distance. In embodiments where both (a) the first and second distances are substantially equal and (b) the third and fourth distances are substantially equal, the head 200 has a substantially constant angular orientation relative to the main body 20 throughout the travel of the jaw assembly 30. Accordingly, an angle between the actuation axis 80 and the main body 20 is substantially constant throughout the travel of the jaw assembly 30. In some embodiments, the actuation axis 80 is substantially longitudinal, substantially parallel to the base portion 100, and/or substantially perpendicular to the grip 120. Maintaining a consistent angular orientation of the actuation axis 80 ensures that the conduit 60 is forced straight onto the fitting 72 with minimal forces causing rotation of the conduit 60 or the device 70.

In other embodiments, the head 200 is slidably coupled to the main body 20. By way of example, the head 200 may define one or more protrusions that are received within a slot or track defined by the main body 20. In such embodiments, the shape of the slot or track may define the path of the jaw assembly 30 relative to the main body 20.

Figure 4:
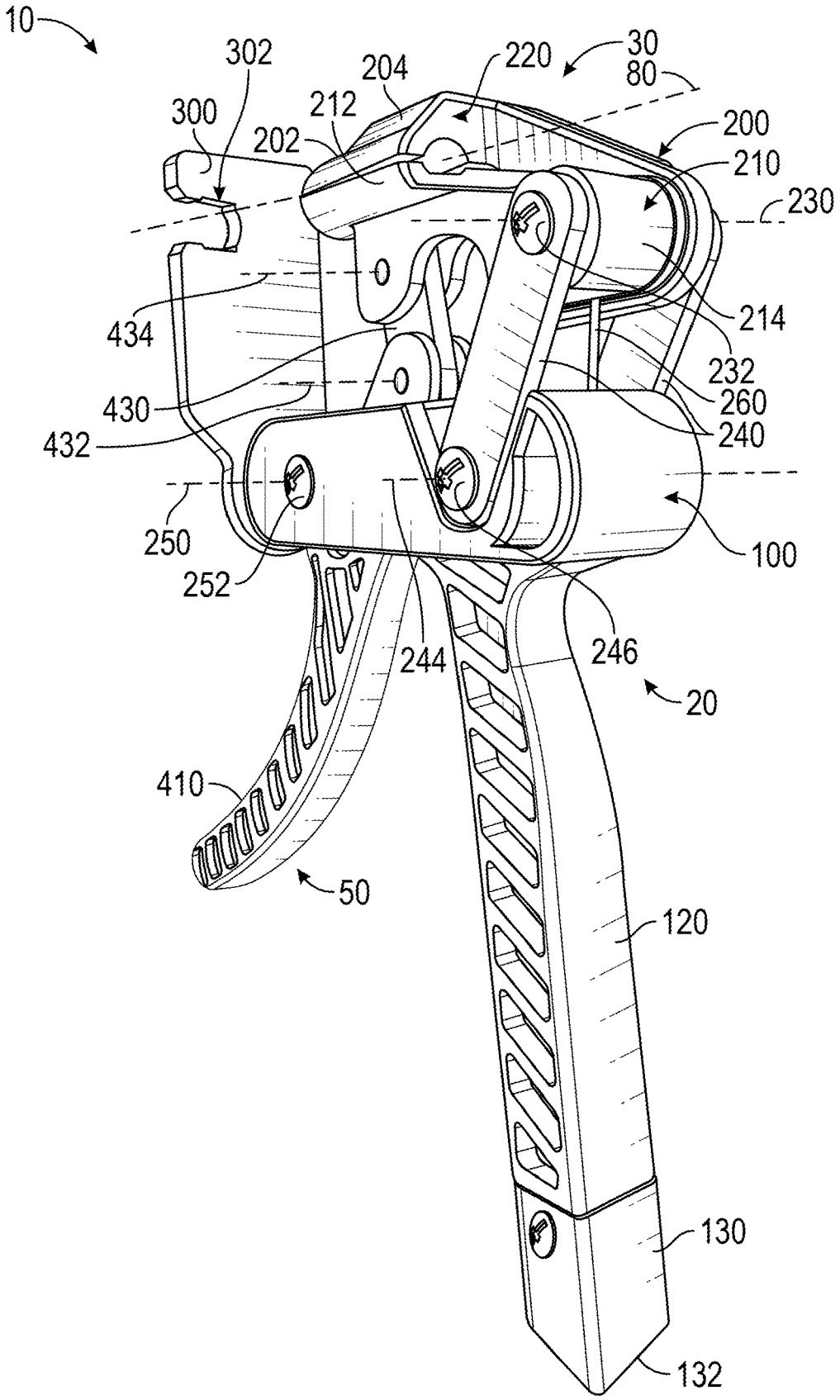
FIG. 4 is a rear perspective view of the fitting insertion tool of FIG. 1.

Referring to FIG. 4, the tool 10 further includes a resilient member, a biasing device, or a biasing element, shown as torsion spring 260. The torsion spring 260 is coupled to at least one of the jaw assembly 30 and the main body 20. By way of example, the torsion spring 260 may include a coiled portion that surrounds the bolt 246 and a tang that extends upward to engage the bolt 232, the head 200, and/or the tongue 210. The torsion spring 260 is configured to apply a biasing force on the head 200 to bias the head 200 toward a fully retracted or disengaged position. As shown in FIGS. 1 and 2, the head 200 is translatable in a first longitudinal direction, shown as engagement direction 262, and a second longitudinal direction opposite the first longitudinal direction, shown as retraction direction 264. The torsion spring 260 is configured to apply a biasing force on the head 200 (e.g., directly, indirectly through another component) at least partially in the retraction direction 264. The fully retracted position is defined as the farthest attainable position of the head 200 in the retraction direction 264. As shown in FIG. 2, the backer plate 104 includes a protrusion, shown as stop 266, extending upward from the base portion 100. When in the fully retracted position, the torsion spring 260 applies a biasing force that holds the head 200 against the stop 266 (e.g., such that a bottom surface of the head 200 engages the stop 266). The biasing force from the torsion spring 260 facilitates one-handed operation of the tool 10, as the user can simply release their grip on the lever 50 to have the head 200 return to the fully retracted position automatically.

Referring to FIGS. 1-4, the backstop 40 includes a plate or wall, shown a support plate 300. The support plate 300 is fixedly coupled (e.g., welded) to the backer plate 104 forward of the jaw assembly 30. In other embodiments, the support plate 300 is removably, slidably, or rotatably coupled to the backer plate 104. The support plate 300 may be arranged substantially perpendicular to the actuation axis 80. The footprint (e.g., as defined by the outermost edges) of the support plate 300 is configured to intersect the actuation axis 80 throughout at least part of the translational range of motion of the jaw assembly 30 (e.g., a portion where the jaw assembly 30 is positioned proximate the support plate 300). In some embodiments, the footprint of the support plate 300 is configured to intersect the actuation axis 80 throughout the majority of or the entirety of the travel of the jaw assembly 30. As shown, the support plate 300 defines a recess, slot, aperture, or grooves, shown as spile alignment groove 302. The actuation axis 80 passes through the spile alignment groove 302 throughout at least part of the translational range of motion of the jaw assembly 30. The spile alignment groove 302 is shown to extend inward from a right side, a front side, and a rear side of the support plate 300. In other embodiments, the spile alignment groove 302 is otherwise shaped.

In operation, the support plate 300 is used to limit (e.g., prevent) movement of the device 70 away from the conduit 60. The body 76 of the device 70 is inserted into the spile alignment groove 302. Engagement between the curved surface of the body 76 and the edge of the spile alignment groove 302 centers the body 76 within the spile alignment groove 302, facilitating axial alignment of the fitting 72 with the conduit 60. Additionally, the engagement between the edge of the spile alignment groove 302 and body 76 may facilitate rotation of the device 70 to assist a user when aligning the fitting 72 with the aperture 62.

Referring to FIG. 1, the lever 50 includes a center portion, shown as coupling portion 400. The coupling portion 400 defines an aperture that receives the bolt 252, pivotally coupling the lever 50 to the main body 20 about the lever pivot axis 250. The lever 50 further includes a user interface portion, shown as trigger 410. The trigger 410 extends downward from the coupling portion 400 such that a user can wrap their hand around the grip 120 and the trigger 410 simultaneously. The user may apply a gripping force on the grip 120 and the trigger 410 to force the grip 120 and the trigger 410 closer together, actuating the tool 10.

The lever 50 further includes an interface portion or clevis, shown as interface portion 420, configured to transfer mechanical energy (e.g., force exerted over a distance) from the trigger 410 to a link, shown as trigger link 430. The trigger 410 and the interface portion 420 are positioned on opposite sides of the lever pivot axis 250. Accordingly, the lever 50 acts as a first class lever in some embodiments.

The trigger link 430 is pivotally coupled to the interface portion 420 about a lateral axis, shown as trigger interface axis 432, and pivotally coupled to the bottom jaw frame 214 about a lateral axis, shown as jaw interface axis 434. Specifically, the trigger link 430 is pivotally coupled to the interface portion 420 by a first fastener or pin, shown as pin 436, and a pivotally coupled to the bottom jaw frame 214 by a second fastener or pin, shown as pin 438. The trigger interface axis 432 extends through the center of the pin 436, and the jaw interface axis 434 extends through the center of the pin 438. In other embodiments, the trigger link 430 is omitted, and the interface portion 420 bears directly against the bottom jaw frame 214. By way of example, the bottom jaw frame 214 and the interface portion 420 may have corresponding cam surfaces that engage one another to facilitate the relative motion described herein.

Figure 5:
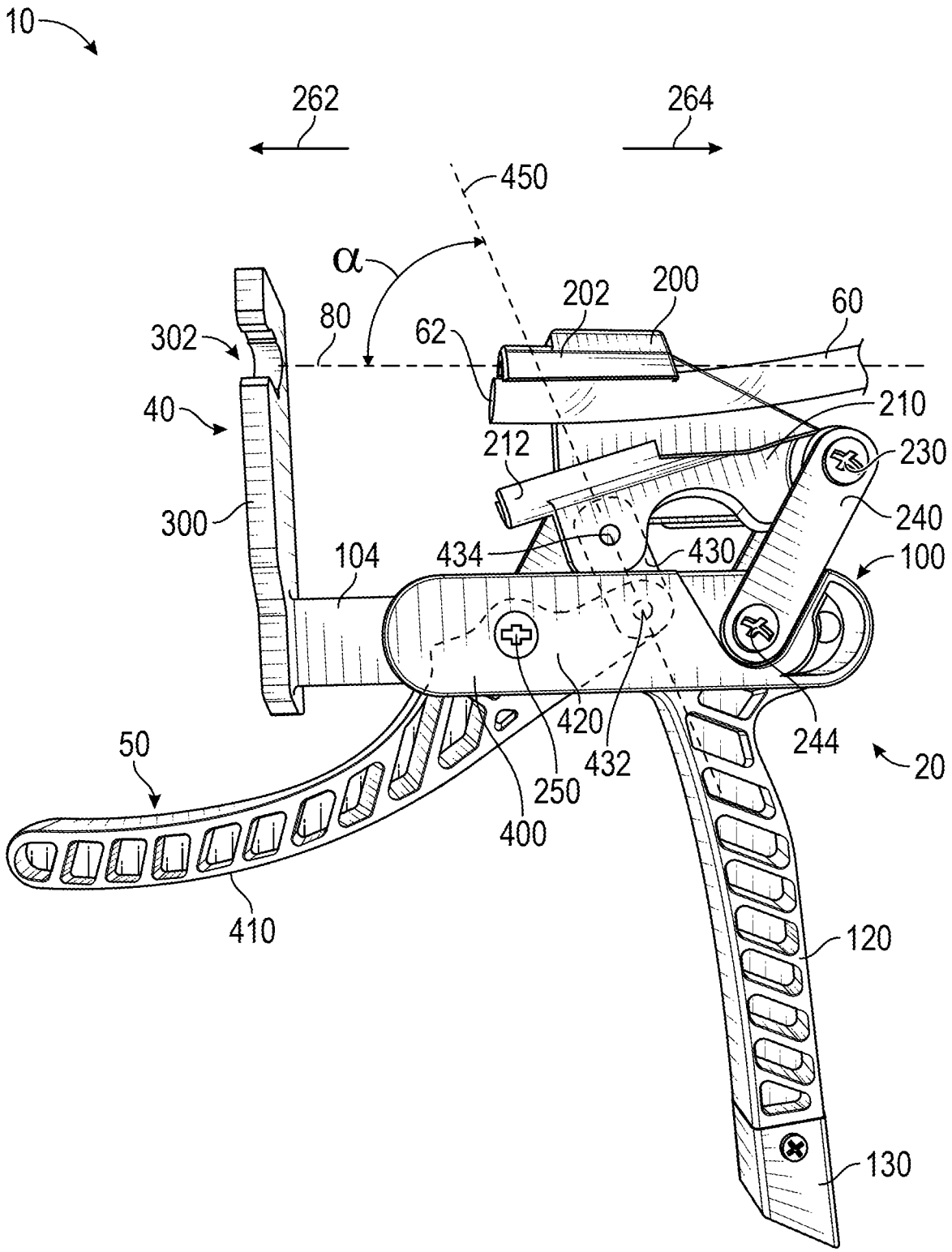
FIGS. 5-9 are left side views of the fitting insertion tool of FIG. 1 in various positions throughout a range of motion of the fitting insertion tool.
Figure 6:
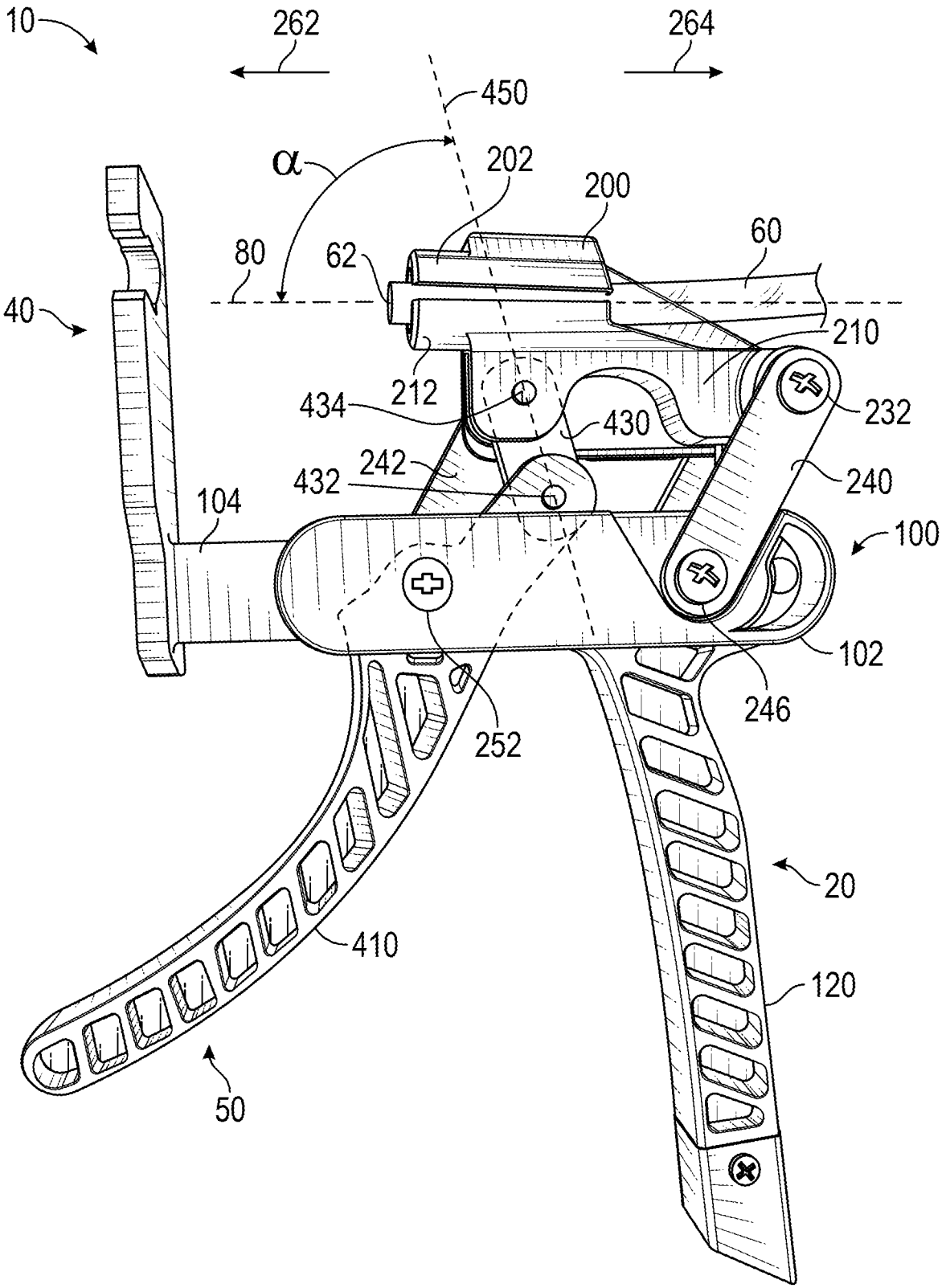
Figure 7:
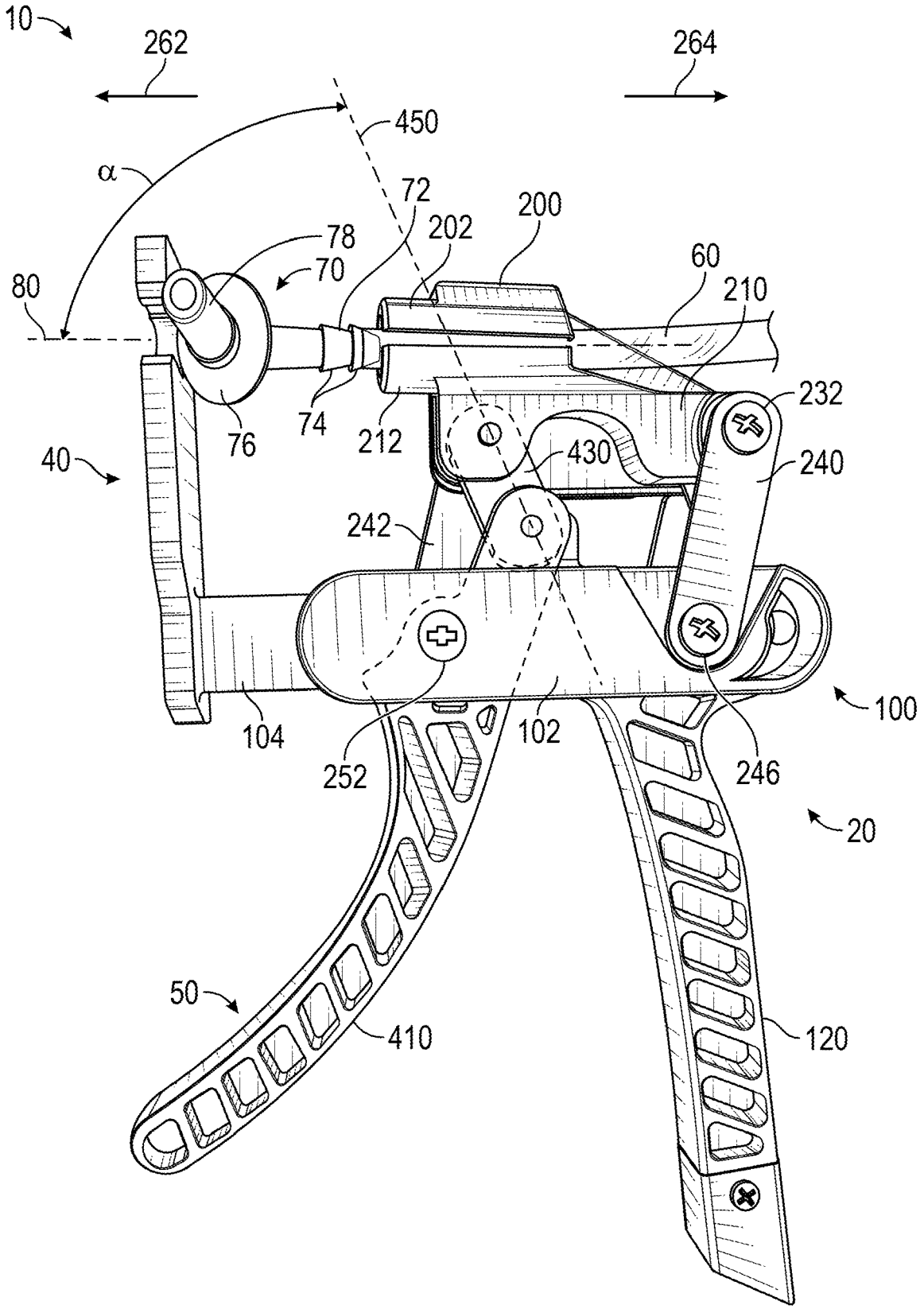
Figure 8:
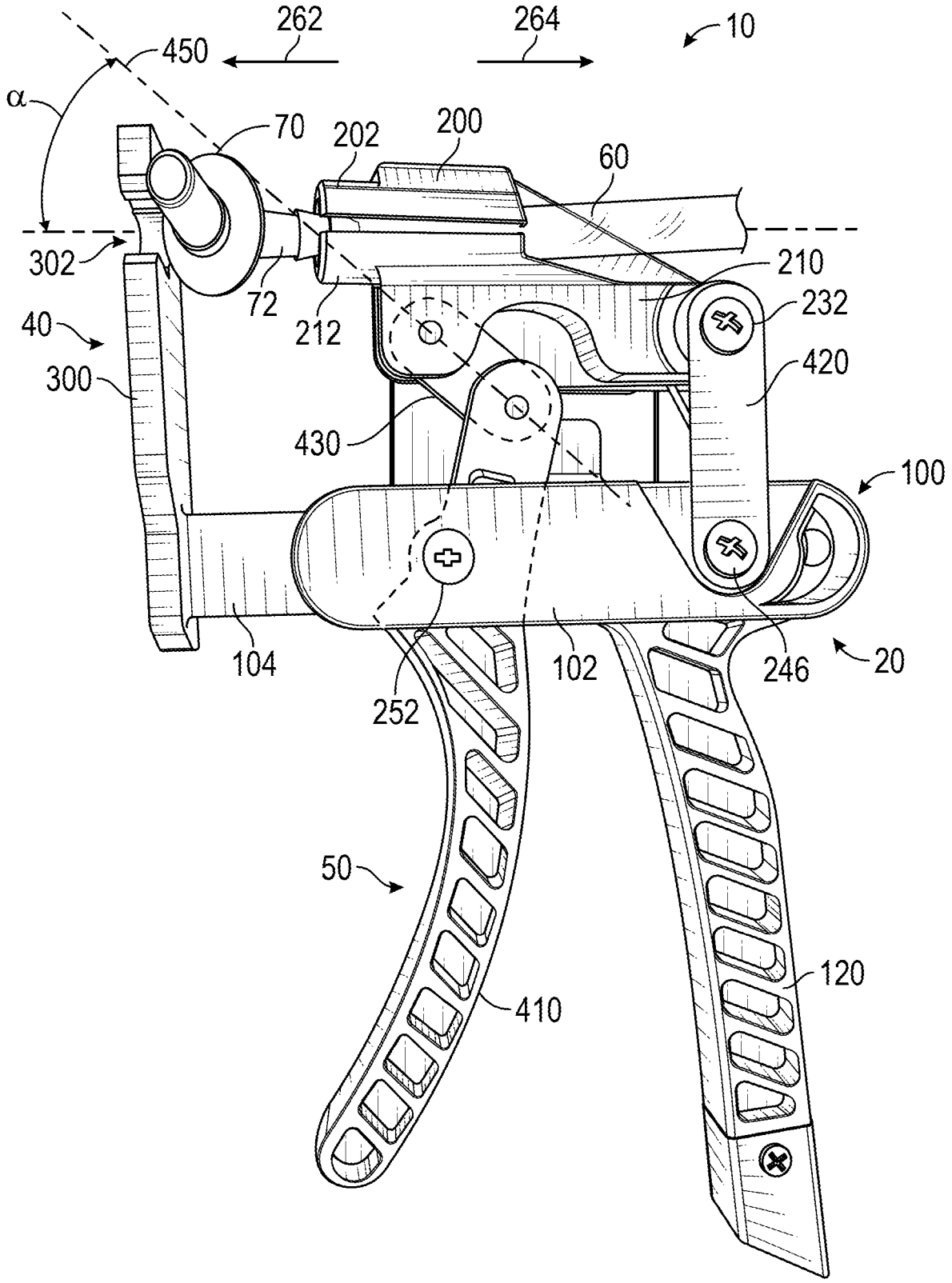
Figure 9:
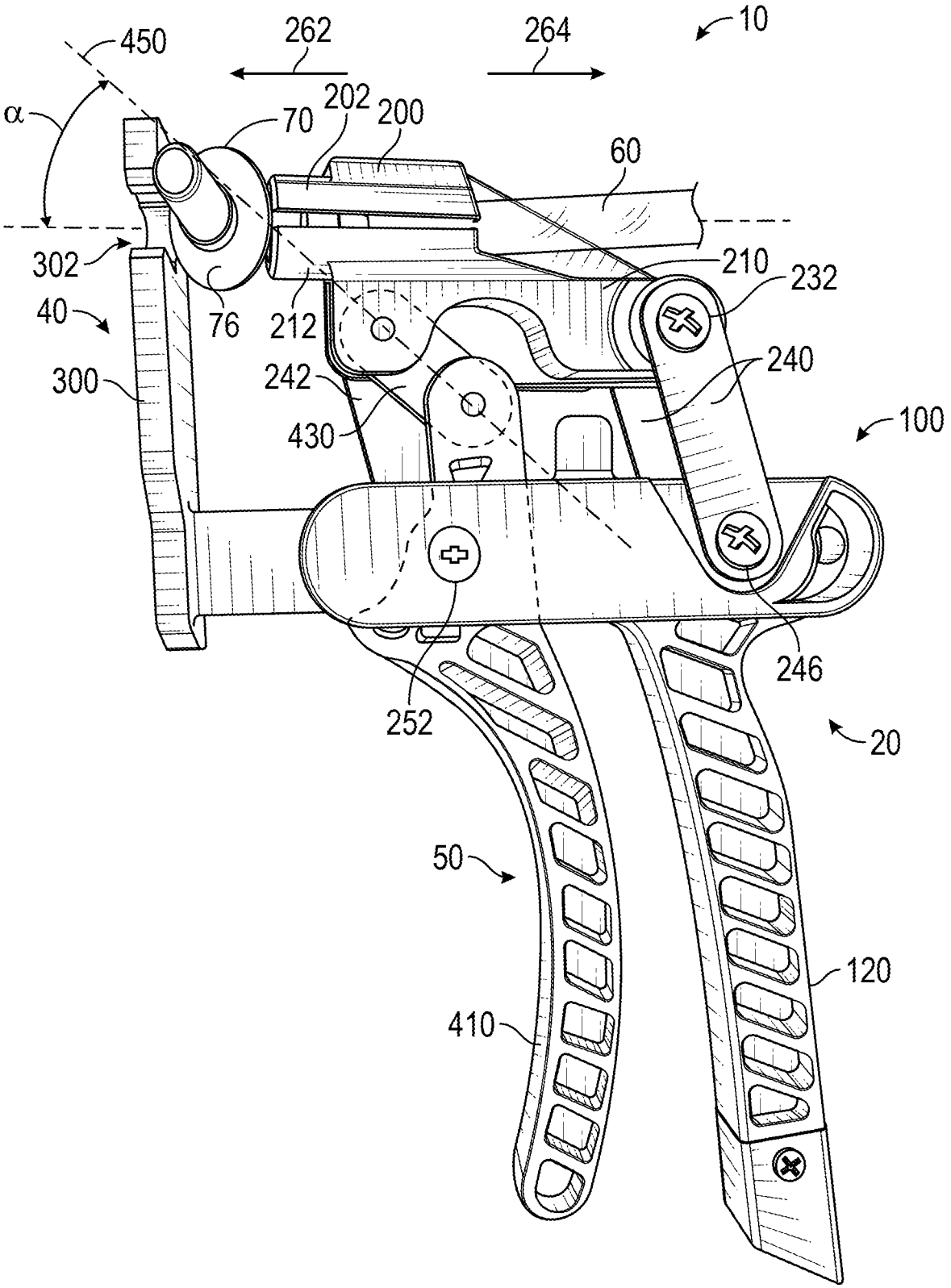

During operation, the trigger 410 controls rotation of the tongue 210 relative to the head 200 and controls translation of the jaw assembly 30 relative to the main body 20. The lever 50 is rotatable relative to the main body 20 through a range of motion starting in the position shown in FIG. 5 and ending in the position shown in FIG. 13. In FIG. 5, the trigger 410 is positioned in the farthest position from the grip 120 (i.e., a fully open position). With the trigger 410 in this position, the torsion spring 260 retains the head 200 in the fully retracted position. As shown in FIGS. 5 and 6, when the trigger 410 is rotated toward the grip 120, the head 200 remains substantially stationary while the tongue 210 rotates relative to the head 200. This continues until resistance to motion of the tongue 210 relative to the head 200 overcomes the biasing force from the torsion spring 260 (i.e., at a transition position). In some situations, this resistance comes from the compressive force of the top jaw 202 and the bottom jaw 212 on the conduit 60 exceeding a threshold force. In other situations, such as a situation where no conduit 60 is loaded between the top jaw 202 and the bottom jaw 212, the resistance comes from the top jaw 202 bearing directly on the bottom jaw 212. As such, the exact location of the transition position may vary based on whether or not a conduit 60 is placed between the top jaw 202 and the bottom jaw 212, the type of conduit 60 being compressed, and the strength (e.g., spring constant) of the torsion spring 260. Some or all of the portion of the range of motion between the fully open position and the transition position may be considered a jaw closing section of the range of motion.

When the trigger 410 continues to move beyond the transition position toward the grip 120, the head 200 moves in the engagement direction 262 while the tongue 210 remains substantially stationary relative to the head 200. The head 200 continues to move in the engagement direction 262 until resistance to motion of the jaw assembly 30 and/or the trigger 410 overcomes the force driving the trigger 410 toward the grip 120 (i.e., at a maximum extension position). In some situations, this resistance comes from the jaw assembly 30 pressing against the backstop 40 (e.g., through the device 70). In other situations (e.g., when no conduit 60 is present within the jaw assembly 30), the resistance comes from the trigger 410 contacting the grip 120. Some or all of the portion of the range of motion between the transition position and the maximum extension position may be considered a jaw translation section of the range of motion. In some embodiments, an angle between the actuation axis 80 and the main body 20 remains substantially constant throughout the jaw translation section.

The lever 50 transfers a force to the tongue 210 through the trigger link 430 along an axis, shown as transmission axis 450, extending perpendicular to and intersecting the trigger interface axis 432 and the jaw interface axis 434. An angle $\alpha$ is defined between the actuation axis 80 and the transmission axis 450. As the angle $\alpha$ decreases, a greater portion of the force exerted by the lever 50 on the trigger link 430 is directed toward translation of the jaw assembly 30 toward the backstop 40, increasing the amount of force that is available to press the conduit 60 onto the fitting 72. As shown in FIGS. 5-9, the angle $\alpha$ gradually decreases as the jaw assembly 30 approaches the backstop 40. When the jaw assembly 30 is used to push the conduit 60 onto the fitting 72, the force required to move the conduit 60 gradually increases as the amount of engagement of the fitting 72 with the conduit 60 increases. Accordingly, the required force increases with the supplied force, reducing the gripping force that an operator is required to supply to the trigger 410.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the fitting insertion tool as shown in the various exemplary embodiments is illustrative only. Additionally, any element disclosed in one embodiment may be incorporated or utilized with any other embodiment disclosed herein.

The invention claimed is:

1. A tool for inserting a fitting of a spile assembly into a conduit, comprising:

a main body including a grip;

a lever pivotally coupled to the main body, the lever including a trigger; and a jaw assembly including:

a first jaw extending along an actuation axis, wherein the first jaw is translatably coupled to the main body such that an angle between the actuation axis and the main body is substantially constant; and a second jaw coupled to the lever and movably coupled to the first jaw, wherein the first jaw and the second jaw are configured to receive the conduit therebetween, wherein the first jaw is configured to move in a first longitudinal direction relative to the main body in response to movement of the trigger toward the grip, wherein the second jaw is configured to move toward the first jaw in response to movement of the trigger toward the grip, wherein the first jaw is a top jaw, wherein the second jaw is a bottom jaw positioned below the top jaw, and wherein the top jaw is pivotally coupled to the bottom jaw about a first lateral axis.

2. The tool of claim 1, further comprising a resilient member coupled to at least one of the main body and the top jaw, wherein the resilient member is configured to bias the top jaw to move in a second longitudinal direction opposite the first longitudinal direction.

3. The tool of claim 2, further comprising a backstop fixedly coupled to the main body, wherein the top jaw is configured to move in the first longitudinal direction toward the backstop in response to the movement of the trigger toward the grip.

4. The tool of claim 3, wherein the first jaw defines a first conduit receiving recess and the second jaw defines a second conduit receiving recess, and wherein the first conduit receiving recess and the second conduit receiving recess face one another such that the conduit can be received within both the first conduit receiving recess and the second conduit receiving recess simultaneously.

5. A tool for inserting a fitting of a spile assembly into a conduit, comprising:

a main body including a grip;

a lever pivotally coupled to the main body, the lever including a trigger;

a jaw assembly including:

a first jaw extending along an actuation axis, wherein the first jaw is translatably coupled to the main body such that an angle between the actuation axis and the main body is substantially constant; and a second jaw coupled to the lever and movably coupled to the first jaw, wherein the first jaw and the second jaw are configured to receive the conduit therebetween, wherein the first jaw is configured to move in a first longitudinal direction relative to the main body in response to movement of the trigger toward the grip; and a first link pivotally coupled to the lever about a first lateral axis and pivotally coupled to the second jaw about a second lateral axis.

6. The tool of claim 5, further comprising:

a second link pivotally coupled to the main body about a third lateral axis and the first jaw about a fourth lateral axis; and a third link pivotally coupled to the main body about a fifth lateral axis and the first jaw about a sixth lateral axis.

7. The tool of claim 6, wherein the lever is pivotally coupled to the main body about the fifth lateral axis, and wherein the second jaw is pivotally coupled to the first jaw about the fourth lateral axis.

8. A fitting insertion tool, comprising:

a main body including a handle;

a lever pivotally coupled to the main body and rotatable relative to the main body through a range of motion, the range of motion including a jaw closing section and a jaw translation section; and a jaw assembly including a first jaw and a second jaw, at least one of the first jaw and the second jaw being movably coupled to the main body, wherein, in response to the lever moving through the jaw closing section of the range of motion, the second jaw is configured to move relative to the first jaw while the first jaw remains substantially stationary relative to the main body; and wherein, in response to the lever moving through the jaw translation section of the range of motion, the second jaw is configured to remain substantially stationary relative to the first jaw while the first jaw moves in a first longitudinal direction relative to the main body.

9. The fitting insertion tool of claim 8, further comprising a resilient member coupled to at least one of the first jaw and the main body, wherein the resilient member is configured to impart a biasing force that resists movement of the first jaw in the first longitudinal direction relative to the main body.

10. The fitting insertion tool of claim 9, further comprising a backstop fixedly coupled to the main body, wherein the jaw assembly is configured to move in the first longitudinal direction toward the backstop in response to the lever moving through the jaw translation section of the range of motion.

11. The fitting insertion tool of claim 10, wherein an angular orientation of the first jaw relative to the main body is substantially constant while the lever moves through the jaw translation section of the range of motion.

12. The fitting insertion tool of claim 11, wherein the second jaw is pivotally coupled to the first jaw, and wherein, in response to the lever moving through the jaw closing section of the range of motion, the second jaw is configured to rotate relative to the first jaw while the first jaw remains substantially stationary relative to the main body.

13. The fitting insertion tool of claim 8, wherein the first jaw defines a first conduit receiving recess and the second jaw defines a second conduit receiving recess, and wherein the first conduit receiving recess and the second conduit receiving recess face one another.

* * * * *